US006412835B1

(12) United States Patent
Patterson

(10) Patent No.: US 6,412,835 B1
(45) Date of Patent: Jul. 2, 2002

(54) CARGO DOOR SAVER

(76) Inventor: Richard Patterson, 1313 E. Lons, Brownfield, TX (US) 79316

( * ) Notice: Subject to any disclaimer, the term of this patent is extended or adjusted under 35 U.S.C. 154(b) by 67 days.

(21) Appl. No.: 09/668,046

(22) Filed: Sep. 21, 2000

(51) Int. Cl.[7] ..... E05C 19/10

(52) U.S. Cl. ..... 292/259 R; 248/225.21; 248/220.22; 410/143; 410/144; 410/152

(58) Field of Search ..... 248/225.21, 223.31, 248/220.22, 220.31, 201; 410/143, 144, 145, 152; 292/259 R

(56) References Cited

U.S. PATENT DOCUMENTS 4,168,667 A * 9/1979 Loomis ..... 105/467
4,335,910 A * 6/1982 Massie ..... 292/259 R
4,669,767 A * 6/1987 Leto ..... 292/259 R
4,772,053 A * 9/1988 Oxley ..... 292/259 R
5,807,047 A * 9/1998 Cox ..... 410/152
5,941,667 A * 8/1999 Hardison ..... 410/146

* cited by examiner

*Primary Examiner*—Teri Pham Luu
(74) *Attorney, Agent, or Firm*—Matthew J. Cohen

(57) ABSTRACT

A cargo door saver (10) having a first member (14A) connected at an approximate 45 degree downward angle to proximal end of a second member (14B) which is connected at distal end at an approximate 45 degree upward angle to a proximal end of a third member (14C). A holder (16) having a holder opening (16A) therethrough is securely attached to a face of the first member (14A). A distal end of a cargo bar (12) is removably insertable into the holder opening (16A). A "U-Shaped" clip (18) is securely attached to a face of the third member (14C). The clip (18) functions to attach the cargo door saver (10) to an E-Track which is attached along a side at the rear of a moving van.

1 Claim, 7 Drawing Sheets

CARGO DOOR SAVER

FIELD OF THE INVENTION

The present invention relates to cargo door saver. More particularly, the present invention relates to cargo door saver removably attachable to E-Tracks positioned at a rear end of a moving van.

DESCRIPTION OF THE PRIOR ART

Numerous innovations for door protectors have been provided in the prior art that are described as follows. Even though these innovations may be suitable for the specific individual purposes to which they address, they differ from the present invention as hereinafter contrasted.

In U.S. Pat. No. 5,169,202, Titled, Multiple-use workbench for use as a tailgate on a truck, invented by Cupp, et. al. comprises an improved fold-down tailgate for use on a truck-like vehicle is disclosed. The tailgate of the present invention employs a slotted work surface which permits the ready attachment of various construction implements, such as cargo ramps, extended work surfaces, and a wide variety of vises, clamps and tie-down devices. The tailgate provides improved functionality while maximizing the amount of cargo space in the vehicle.

In U.S. Pat. No. 5,168,258, Titled, Protective device for padlocks for truck cargo doors, invented by Radke comprises a protective device for a padlock as typically used on the cargo doors of a trailer portion of a truck/trailer combination. Particularly, the device is intended to protect the lock from the environment and to provide a warning of unauthorized access. The preferred embodiment includes a base which is fastened to the door and surrounds the keeper of the lock assembly, a cover pivotally mounted to the base and enclosing the lock, a switch mounted to the cover for detecting displacement of the cover from its closed position and an audible alarm responsive to the switch for emitting a warning signal.

In U.S. Pat. No. 5,000,503, Titled, Tailgate protector, invented by Bematek comprises a pick-up truck tailgate protective cover which protects the tailgate in a pick-up truck is fastened to the tailgate of a pick-up truck without drilling or perforating the tailgate. The tailgate protective cover is mounted to the pick-up truck tailgate by having one of its ends terminate in a hook-like end portion which is adapted to receive the top of the tailgate and another of its end portions employs a depending connector which cooperates with a fastening means and an existing tailgate aperture wherein the fastening means fastens the depending connector to the existing tailgate aperture.

In U.S. Pat. No. 4,389,067, Titled, Tailgate protecting device, invented by Rubio comprises a tailgate protecting device including an elongated section of pipe or other rigid beam forming a structure which is long enough to span the width of the load carrying portion of a pickup truck, a pair of vertical support members affixed to the elongated beam proximate its ends, and a pair of laterally extending brackets for engaging the tailgate and holding the device in position. When in operation, the device is capable of supporting loads extending beyond the bed of the truck and over the tailgate, thereby protecting the tailgate from damage.

In U.S. Pat. No. 4,372,136, Titled, Lock protecting hasp, invented by Mickelson comprises a Lock-protecting hasp for trailer full swing rear doors having locking bars which secures to the bars of the rear doors and includes two mating members and a shackle lock whether the lock be key or combination. A protecting block against the lock on the female mating member protects the shackle of the lock from being cut or pried off the body of the lock, or between the shackle, the body and the lock-protecting hasp. Longitudinal opposing slots and a ribbed locking bar on the male mating member provide for adjustability between the two members for accepting door bars spaced any distance dependent upon the type of trailer. The lock-protecting hasp particularly lends itself to use on semi-trailers having full swing rear doors and the lock-protecting hasp accepts a lock of predetermined size.

In U.S. Pat. No. 1,977,655, Titled, TAIL GATE ELEVATOR, invented by TroeA comprises an invention herein illustrated are like the patent structure above identified, in consisting of rectangular cross-section sliding (CI. 214-15) ram or shoes 10, operating in the boxes or guides made up of the angularly bent U-shaped housings 11, secured over the ends of the truck sides 12, these rams being connected at their lower ends by a stay rod 13, on which the tail gate 14, is pivotally hung at 15.

The above patented inventions differ from the present invention because they fail to describe or claim at least one combination of the following features depicted in the present invention: first member with a holder, second member, and third member with a clip having a pair of clip top notches and a pair of clip bottom notches and a clip opening therethrough.

Numerous innovations for door protectors have been provided in the prior art that are adapted to be used. Even though these innovations may be suitable for the specific individual purposes to which they address, they would not be suitable for the purposes of the present invention as heretofore described.

SUMMARY OF THE INVENTION

The present invention relates to cargo door saver removably attachable to E-Tracks positioned at a rear end of a moving van.

The types of problems encountered in the prior art are rear cargo doors are still left unprotected.

In the prior art, unsuccessful attempts to solve this problem were attempted namely: different configurations of protectors. However, the problem was solved by the present invention because its removably attachable to E-Tracks positioned at a rear end of a moving van and employs a pair or cargo door savers at each distal end of a cargo bar.

Innovations within the prior art are rapidly being exploited in the field of vehicle protection devices.

The present invention went contrary to the teaching of the art which describes and claims different configurations of door protectors.

The present invention solved a long felt need for a cargo door protector.

Accordingly, it is an object of the present invention to provide a cargo door saver having a first member with a holder attached thereto connected to a third member with a clip attached thereto by a second member.

More particularly, it is an object of the present invention to provide the holder has a holder opening into which a distal end of a cargo bar is inserted.

In keeping with these objects, and with others which will become apparent hereinafter, one feature of the present invention resides, briefly stated, in the clip having a clip top notches, clip bottom notches and clip opening.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings.

LIST OF REFERENCE NUMERALS UTILIZED IN THE DRAWINGS

10—cargo door saver (10)
12—cargo bar (12)
14A—first member (14A)
14B—second member (14B)
14C—third member (14C)
16—holder (16)
16A—holder opening (16A)
18—clip (18)
18T—clip top notch (18T)
18B—clip bottom notch (18B)
18C—clip opening (18C)

DESCRIPTION OF THE PREFERRED EMBODIMENT

Figure 1:
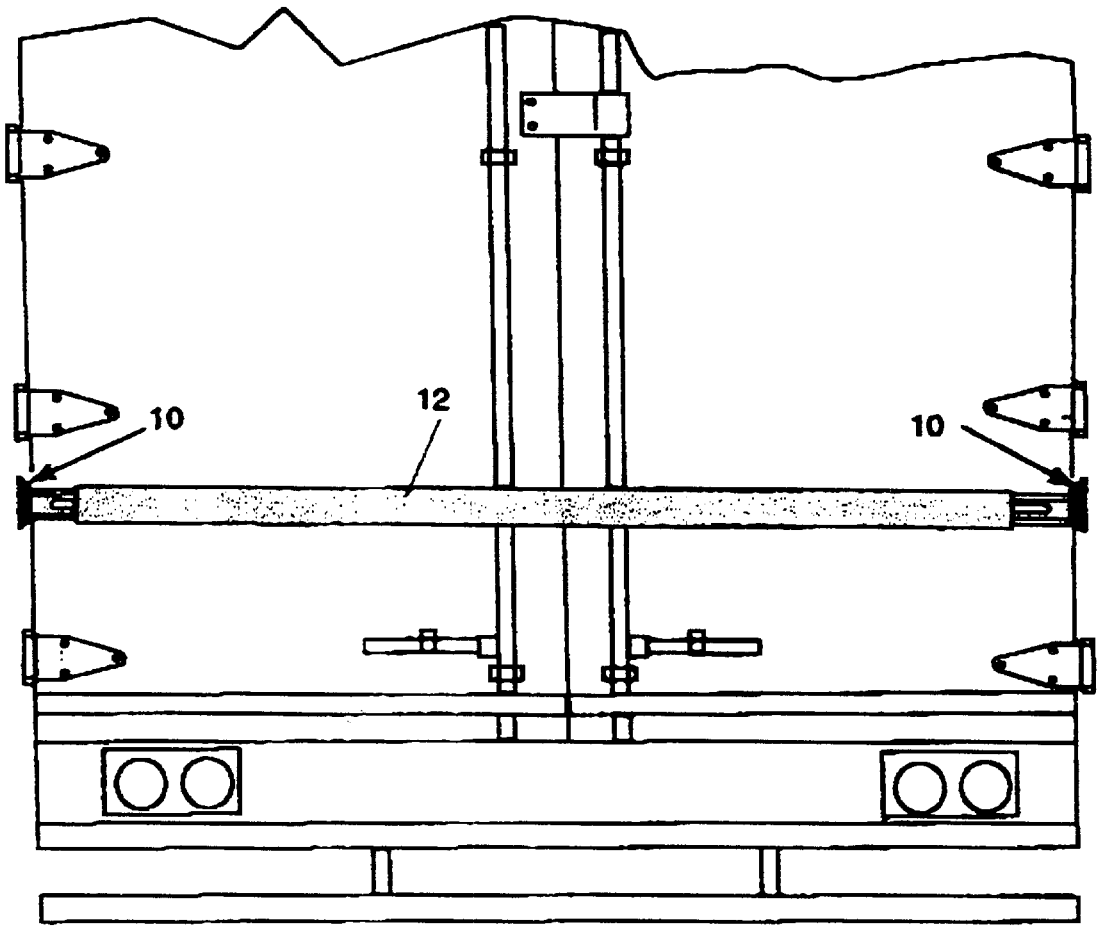
FIG. 1 s a rear view of a moving van with a pair of cargo door savers (10), each attached to an E-Track on opposite sides of a cargo door with a cargo bar (12) inserted into the pair of cargo door savers (10).
Figure 2:
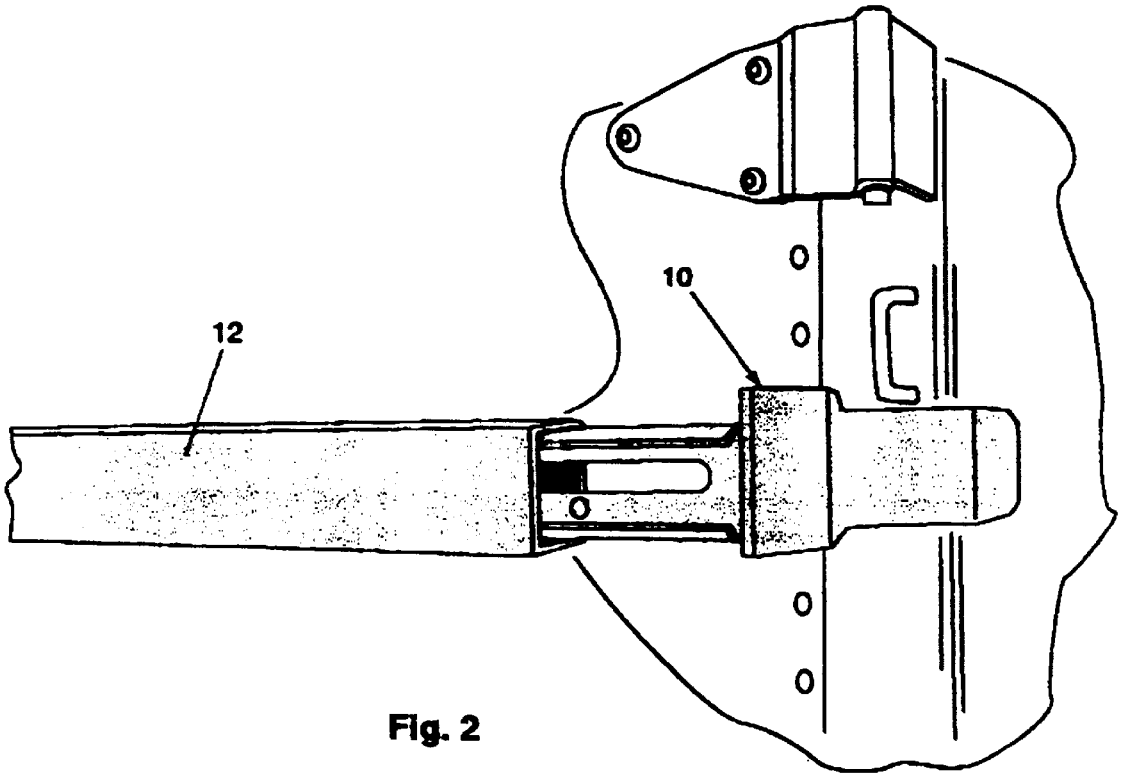
FIG. 2 is a right rear perspective view of a moving van with a cargo door saver (10) attached to an E-Track on the side of a cargo door with a cargo bar (12) inserted into the cargo door saver (10).

Referring to FIG. 1 and FIG. 2 which are a rear view and right rear perspective view, respectively, of a moving van with a pair of cargo door savers (10), each attached to an E-Track on opposite sides of a cargo door with a cargo bar (12) inserted into the pair of cargo door savers (10). A distal end of a first member (14A) is connected at an approximate 45 degree downward angle to proximal end of a second member (14B) which is connected at distal end at an approximate 45 degree upward angle to a proximal end of a third member (14C). (refer to FIG. 5A)

Figure 3A:
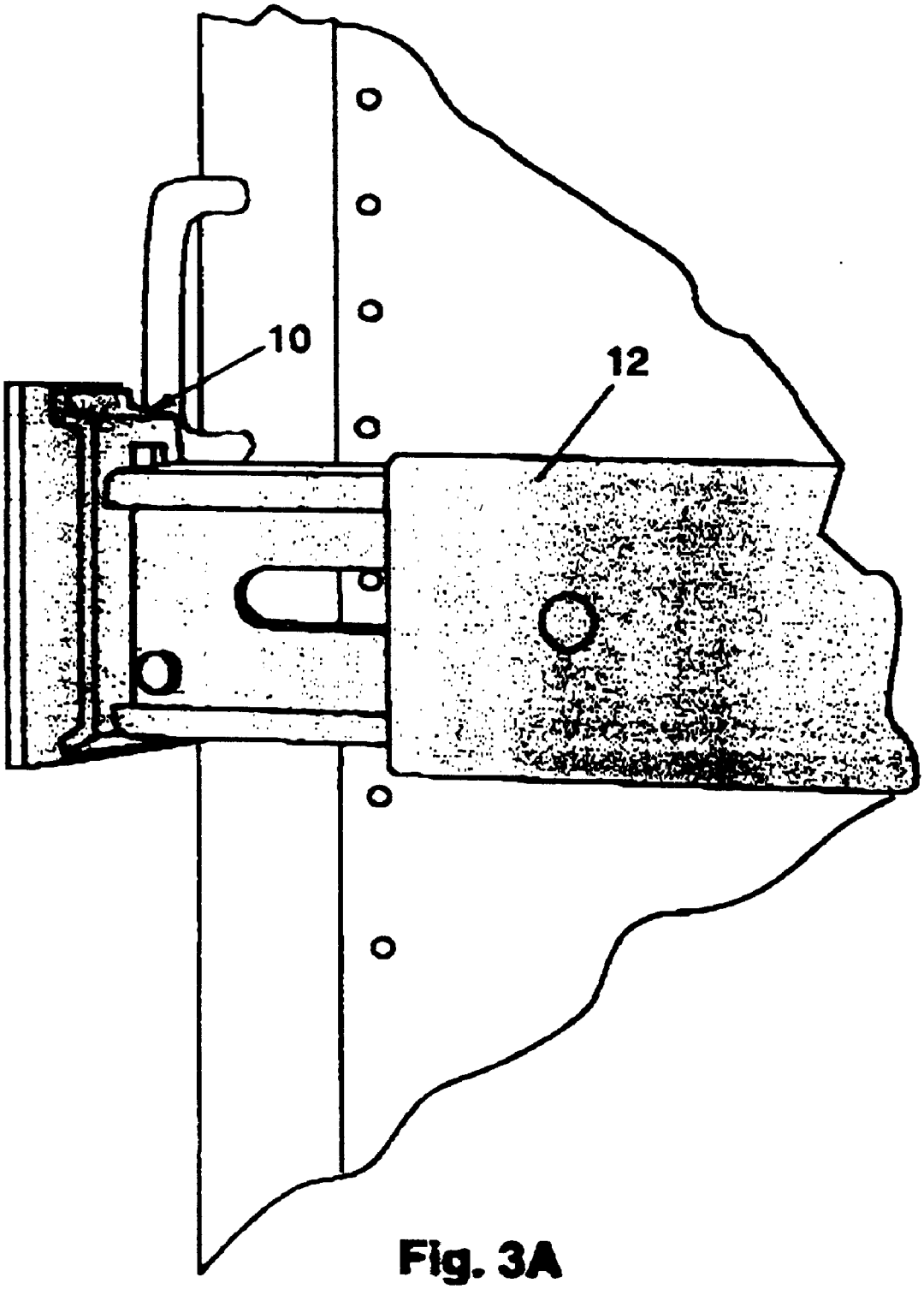
FIG. 3A is a rear left perspective view of a moving van with a cargo door saver (10) attached to an E-Track on the side of a cargo door with a distal end of a cargo bar (12) inserted therein.
Figure 3B:
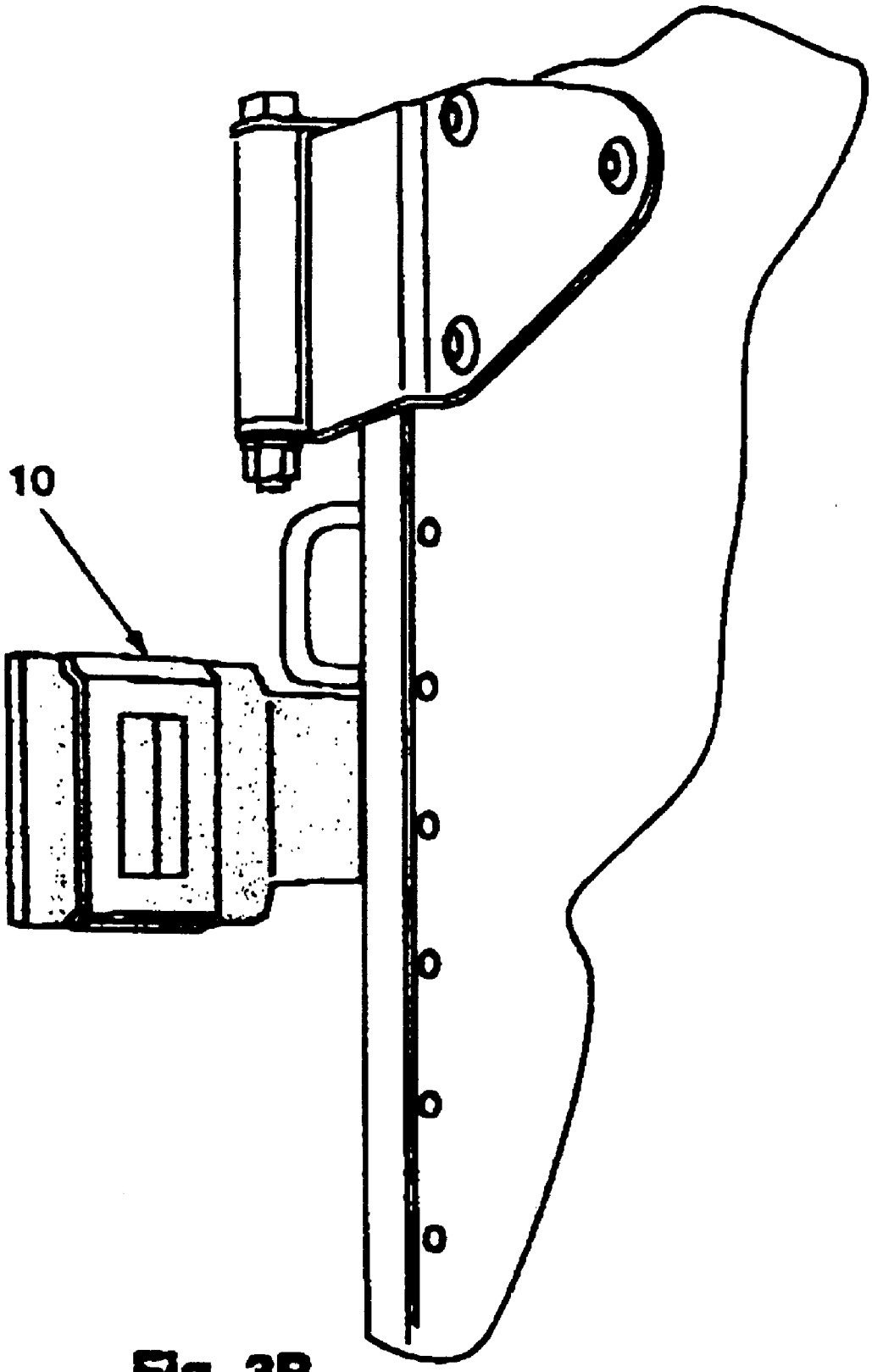
FIG. 3B is a rear left perspective view of a moving van with a cargo door saver (10) attached to an E-Track on the side of a cargo door.

The cargo door saver (10) further comprises a holder (16) having a holder opening (16A) therethrough is securely attached to a face of the first member (14A). (Refer to FIG. 3B and FIG. 5A) A distal end of a cargo bar (12) is removably insertable into the holder opening (16A). (Refer to FIG. 3A)

Figure 4:
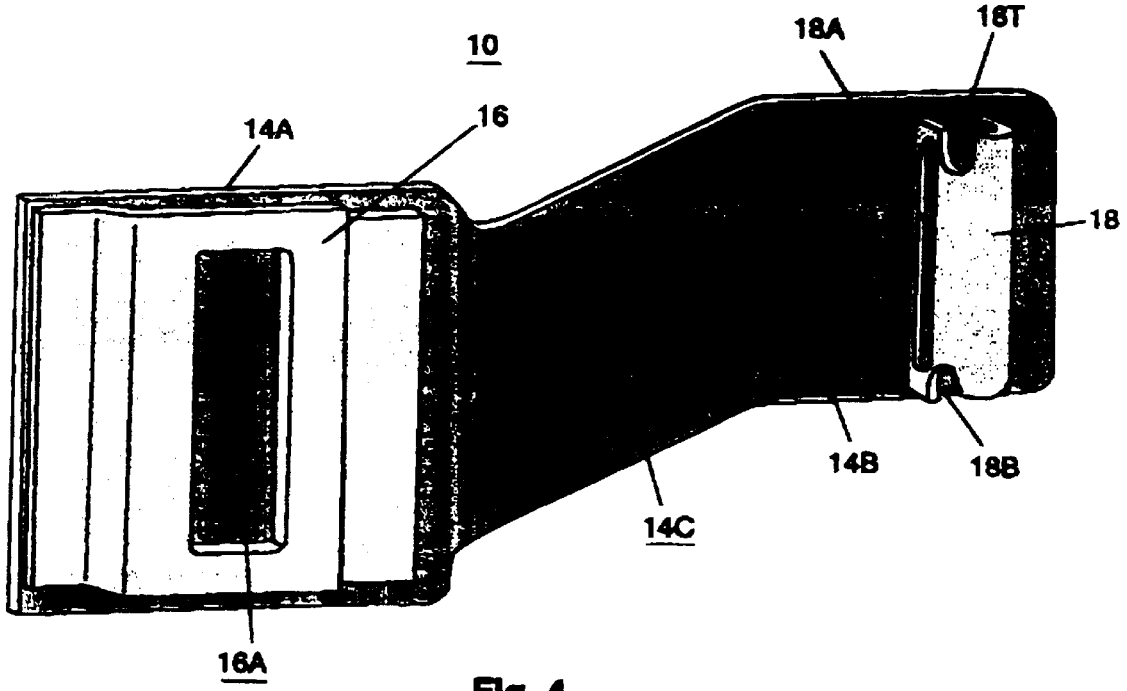
FIG. 4 is a top back perspective view of a cargo door saver (10).
Figure 5A:
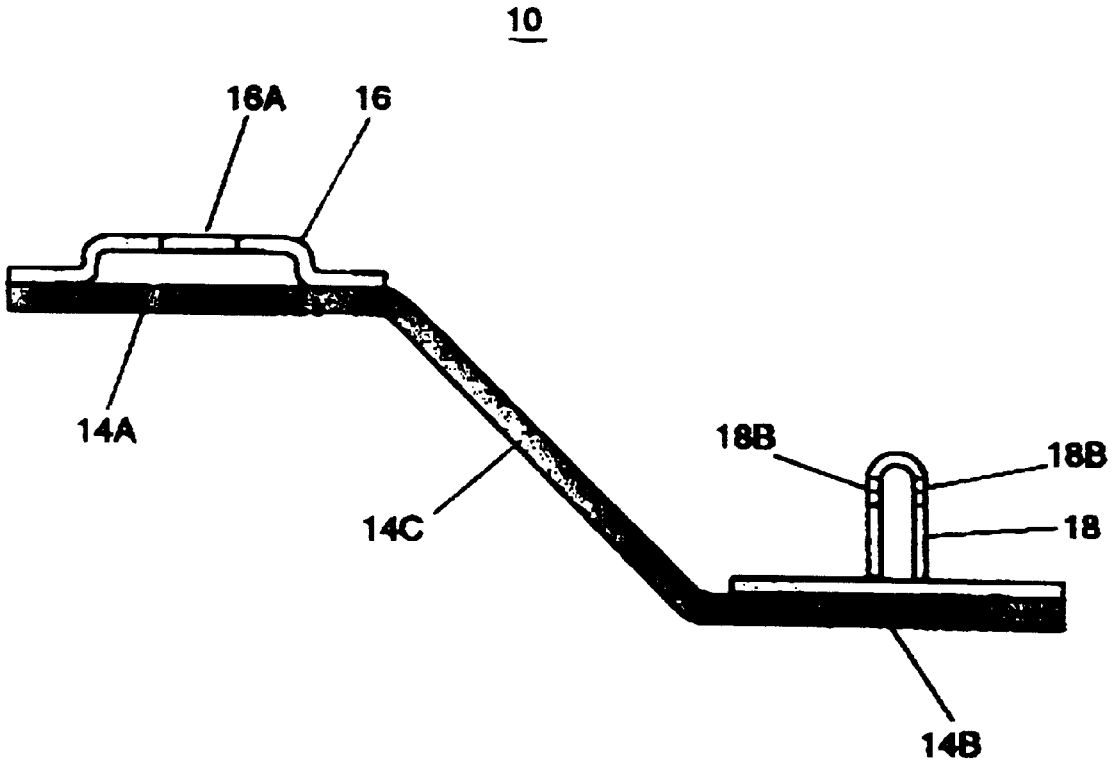
FIG. 5A is a top view of a cargo door saver (10).
Figure 5B:
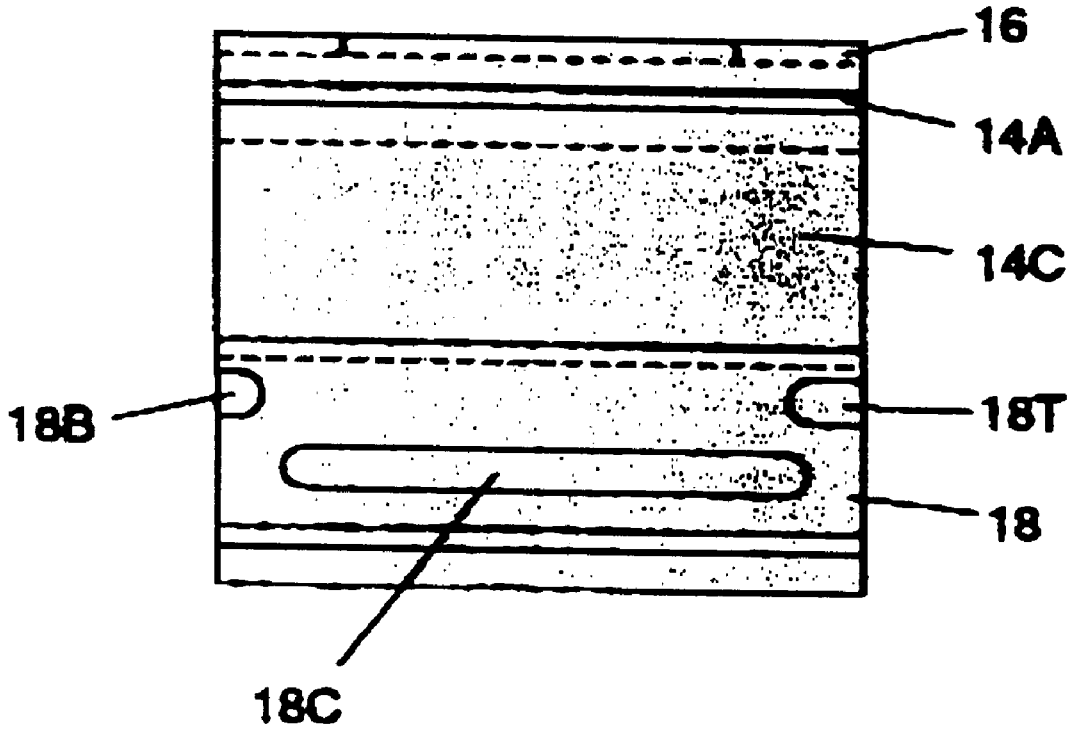
FIG. 5B is a side view of a cargo door saver (10).

Lastly, referring to FIG. 5A, FIG. 5B and FIG. 4, the cargo door saver (10) further comprises a "U-Shaped" clip (18) securely attached to a face of the third member (14C). The clip (18) comprises a pair of clip top notches (18T) in a parallel position to each other on a bottom thereof and a pair of clip bottom notches (18B) in a parallel position to each other on a bottom thereof. (refer to FIG. 5A) The clip (18) further comprises a clip opening (18C) therethrough (refer to FIG. 5B). The clip (18) functions to attach the cargo door saver (10) to an E-Track which is attached along a side at the rear of a moving van.

The cargo door saver (10) functions in conjunction with the cargo bar (12) to protect the rear doors of a moving van from being damaged when merchandise is carried on the tail gate preventing scratches, dents and holes.

It will be understood that each of the elements described above, or two or more together, may also find a useful application in other types of constructions differing from the type described above.

While the invention has been illustrated and described as embodied in a door protectors, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. A cargo door saver (10) comprising:

B) a distal end of a first member (14A) connected at an approximate 45 degree downward angle to a proximal end of a second member (14B) which is connected at a distal end at an approximate 45 degree upward angle to a proximal end of a third member (14C);

C) a holder (16) having a holder opening (16A) therethrough is securely attached to a face of the first member (14A), a distal end of a cargo bar (12) is removably insertable into the holder opening (16A); and D) a "U-Shaped" clip (18) securely attached to a face of the third member (14C), the clip (18) comprises a pair of clip top notches (18T) in a parallel position to each other on a top thereof and a pair of clip bottom notches (18B) in a parallel position to each other on a bottom thereof, the clip (18) further comprises a clip opening (18C) therethrough.

* * * * *